US007954512B2

(12) United States Patent
Le Devehat

(10) Patent No.: US 7,954,512 B2
(45) Date of Patent: Jun. 7, 2011

(54) DISCHARGE ARM ASSEMBLY WITH GUIDING CABLE

(75) Inventor: Renaud Le Devehat, Thorigny-sur-Oreuse (FR)

(73) Assignee: FMC Technologies SA, Sens (FR)

( * ) Notice: Subject to any disclaimer, the term of this patent is extended or adjusted under 35 U.S.C. 154(b) by 626 days.

(21) Appl. No.: 10/554,040

(22) PCT Filed: Apr. 20, 2004

(86) PCT No.: PCT/EP2004/004527

§ 371 (c)(1),
(2), (4) Date: Apr. 30, 2007

(87) PCT Pub. No.: WO2004/094296

PCT Pub. Date: Nov. 4, 2004

(65) Prior Publication Data

US 2009/0065078 A1 Mar. 12, 2009

(30) Foreign Application Priority Data

Apr. 23, 2003 (FR) ..... 03 04999

(51) Int. Cl.
*F15B 13/00* (2006.01)

(52) U.S. Cl. ..... 137/615; 141/387

(58) Field of Classification Search ..... 137/615; 212/307–310; 141/387, 388

See application file for complete search history.

(56) References Cited

U.S. PATENT DOCUMENTS

| | | | | | |
|---|---|---|---|---|---|
| 2,660,110 | A | * | 11/1953 | Boutwell | 225/93 |
| 2,722,230 | A | * | 11/1955 | Toussaint | 137/615 |
| 3,032,082 | A | * | 5/1962 | Vilain | 137/615 |
| 3,249,121 | A | * | 5/1966 | Bily | 137/615 |
| 3,964,512 | A | * | 6/1976 | Dumas | 137/615 |
| 4,206,782 | A | * | 6/1980 | Tuson | 137/615 |
| 4,299,261 | A | | 11/1981 | Talafuse | |
| 4,418,718 | A | * | 12/1983 | Fusy | 137/615 |
| 4,715,404 | A | * | 12/1987 | Fusy | 137/615 |
| 6,343,620 | B1 | | 2/2002 | LeDevehat et al. | |
| 6,719,008 | B1 | * | 4/2004 | LeDevehat | 137/615 |
| 6,886,611 | B2 | | 5/2005 | Dupont et al. | |
| 7,147,022 | B2 | * | 12/2006 | Le Devehat | 137/615 |
| 2009/0205343 | A1 | | 8/2009 | Dupont et al. | |

FOREIGN PATENT DOCUMENTS

| | | | |
|---|---|---|---|
| FR | 1.415.279 | A | 11/1964 |
| FR | 2 813 872 | A1 | 3/2002 |
| GB | 1 591 646 | A | 6/1981 |
| WO | WO 01/04041 | * | 1/2001 |
| WO | WO 01/04041 | A2 | 1/2001 |
| WO | WO 02/22491 | * | 3/2002 |

* cited by examiner

*Primary Examiner* — John Rivell
*Assistant Examiner* — Craig Price

(57) ABSTRACT

Assembly for loading and unloading products, comprising a balanced loading and unloading arm installed at a first location and having a compass-style duct system mounted by one of its ends on a base and provided at the other of its ends with a connection system suitable for connecting the compass-style duct system to a coupling means installed at the second location, this assembly comprising, in addition, a cable joined on the one hand to means integral with the base and suitable for subjecting this cable to a constant tension and suitable for being joined, on the other hand, to the second location, the assembly also comprising guiding means capable of co-operating with the cable so as to guide the connection system along a trajectory materialized by the said cable until the connection system is brought into a position of connection to the coupling means.

16 Claims, 14 Drawing Sheets

DISCHARGE ARM ASSEMBLY WITH GUIDING CABLE

BACKGROUND OF THE INVENTION

A subject of the invention is an articulated arm for loading and unloading products, in particular fluid products, such as for example petroleum products (liquefied natural gas . . . ).

More particularly it relates to a balanced loading arm equipped with a hydraulic coupling allowing a transfer to be carried out between two vessels moored side-by-side, between a vessel and a platform or a floating barge moored side-by-side, or also between a jetty on which the loading arm is installed and a vessel moored alongside this jetty.

Such loading arms are known, in particular from patent application FR 2 813 873. This document describes a connection-assistance system which is composed principally of a constant-tension system (winch, jack, counterweight or other), and a so-called conventional winch, installed at the connection system of the loading arm.

The aim of the invention is to eliminate the risks of impacts between the end of the manifold of the vessel and the coupling means of the loading arm. In particular it aims to permit the connection/disconnection of the loading arm to vessels in difficult meteorological conditions.

SUMMARY OF THE INVENTION

To this end, the invention relates to an assembly for loading and unloading products, comprising a balanced loading and unloading arm installed at a first location and having a compass-style duct system mounted by one of its ends on a base and provided at the other of its ends with a connection system suitable for connecting the compass-style duct system to a coupling means installed at the second location, characterized in that it comprises, in addition, a cable joined on the one hand to means integral with the base and suitable for subjecting this cable to a constant tension and suitable for being joined, on the other hand, to the second location, the loading and unloading assembly also comprising guiding means capable of co-operating with the cable so as to guide the connection system along a trajectory materialized by the said cable until the connection system is brought into a position of connection to the coupling means.

According to preferred provisions of the invention, combined where appropriate:

- the guiding means comprise a drive winch, integral with the connection system, suitable for providing the said guiding of the connection system on the cable and also suitable for driving by friction the movement of the connection system along the cable, when the latter is stretched between the first location and the second location;
- the cable is fitted, on its part intended to be joined to the second location, with means suitable for co-operating with a locking system integral with the second location and permitting the cable to be kept tied to the second location;
- the said means suitable for co-operating with a locking system comprise a sleeve crimped onto the cable;
- the said guiding means comprise means for clamping the connection system onto the cable and also means of winding the cable, the latter being connected by one of its ends to the means suitable for subjecting this cable to a constant tension and, by the other of its ends, to the said winding means, whilst the cable is joined to the second location by a return pulley;

- the said means for winding the cable comprise an approach winch integral with the base;
- the cable crosses the connection system from one side to the other;
- the means suitable for subjecting the cable to a constant tension also comprise an emergency disconnection system for the cable;
- the means suitable for subjecting the cable to a constant tension comprise a winder and the said emergency disconnection system comprises a device for clamping the cable suitable for releasing said cable when the latter is unwound beyond a predetermined minimum number of turns;
- the loading and unloading assembly comprises an alignment guide integral with the connection system and capable of keeping at a distance from the connection system a ring through which the cable passes;
- the loading and unloading assembly comprises a rotation device capable of ordering an angular movement of the connection system relative to the compass-style duct system A subject of the invention is also a combination comprising an assembly as described previously, characterized in that it also comprises coupling means fitted with means for fixing to the second location, these coupling means being suitable for co-operating with the said connection system.

According to a preferred characteristic, the connection system comprises a female truncated conical element and the coupling means comprise a male truncated conical element, the female truncated conical element and the male truncated conical element being suitable for fitting into each other to define a relative positioning of the said assembly and said coupling means.

BRIEF DESCRIPTION OF THE DRAWINGS

Other characteristics and advantages of the invention appear in the light of the description that will follow of a preferred embodiment given by way of non-limitative example, which description refers to the attached drawings in which:

FIG. 10 is an elevation view representing the connection system of FIG. 9, the hydraulic coupling being face-on;

FIG. 15 represents side by side two views of the locking handle of FIGS. 13 and 14, this handle being represented respectively in profile (as in FIG. 14) and face-on;

DETAILED DESCRIPTION OF THE INVENTION

Figure 1:
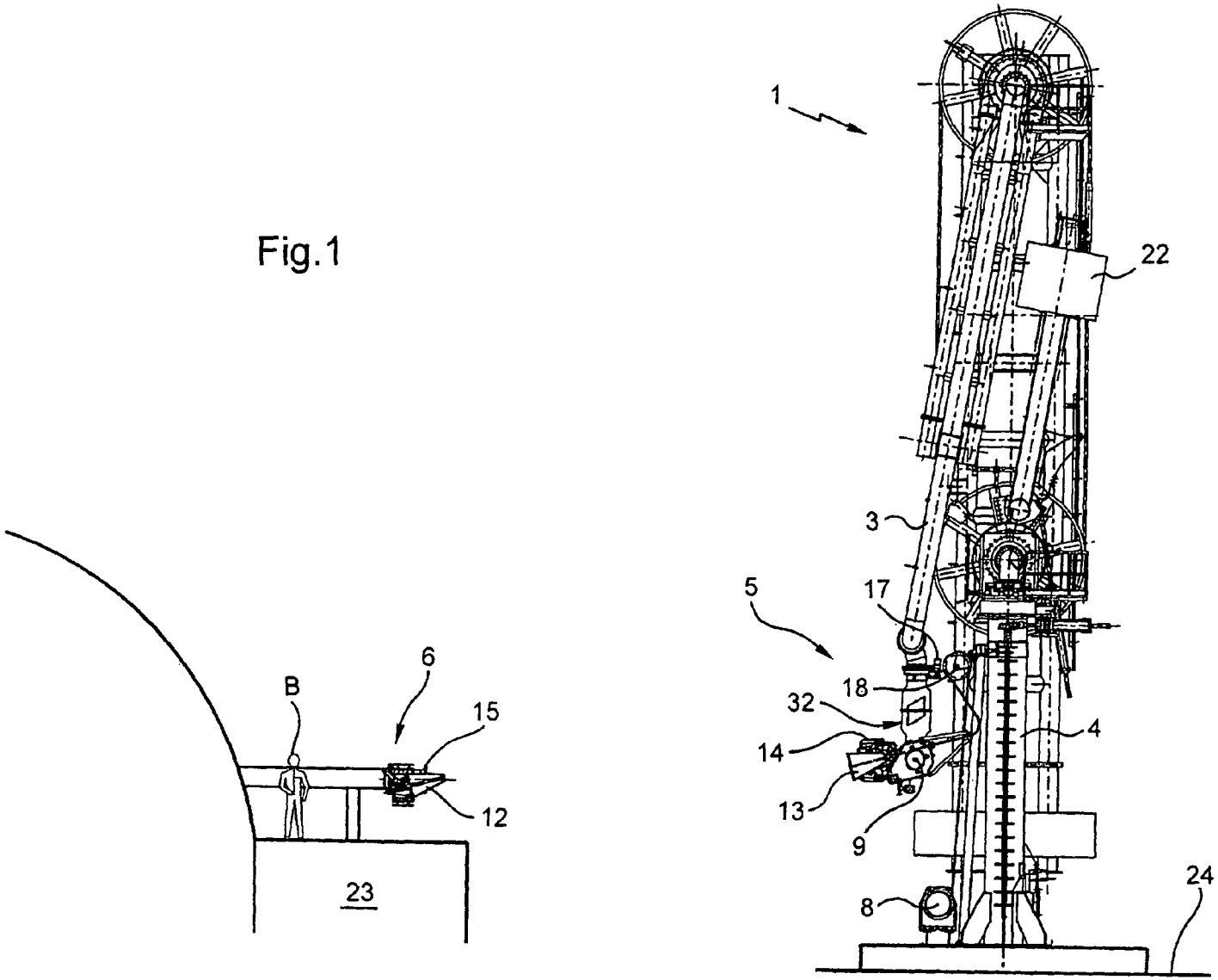
FIGS. 1 to 8 illustrate different stages of the connection of a loading and unloading assembly according to the invention, installed on a jetty, to a vessel moored alongside the jetty.
Figure 2:
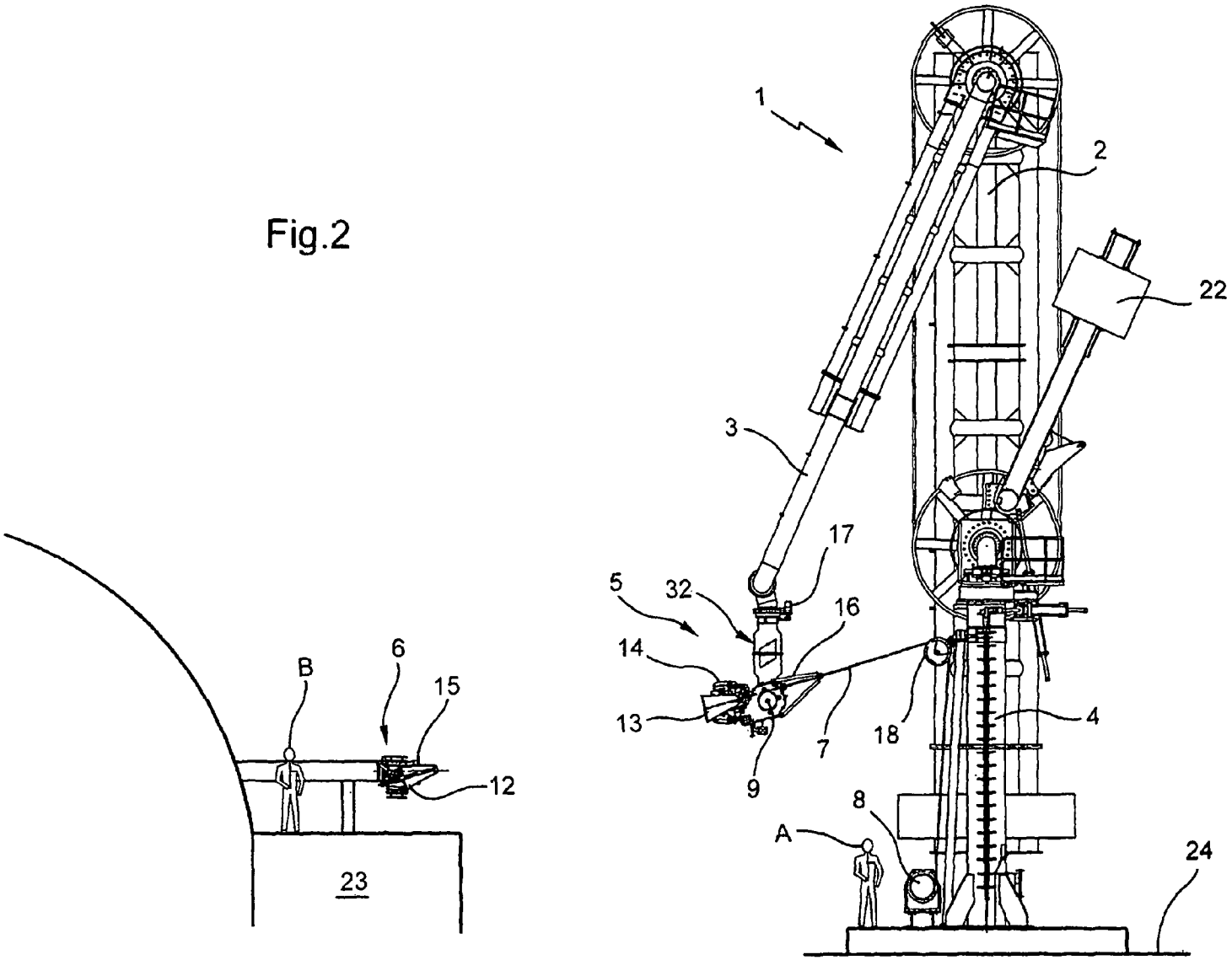
Figure 3:
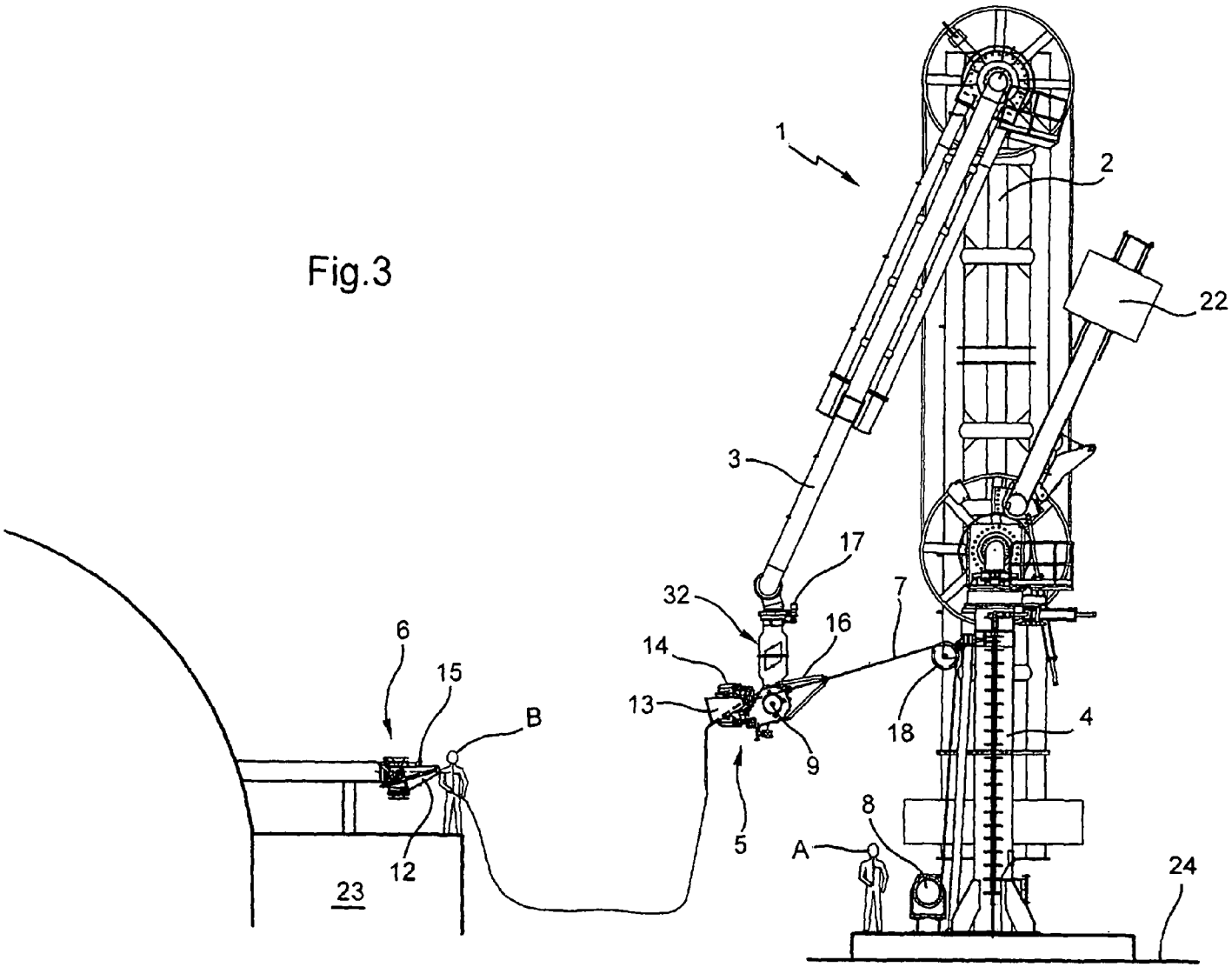
Figure 4:
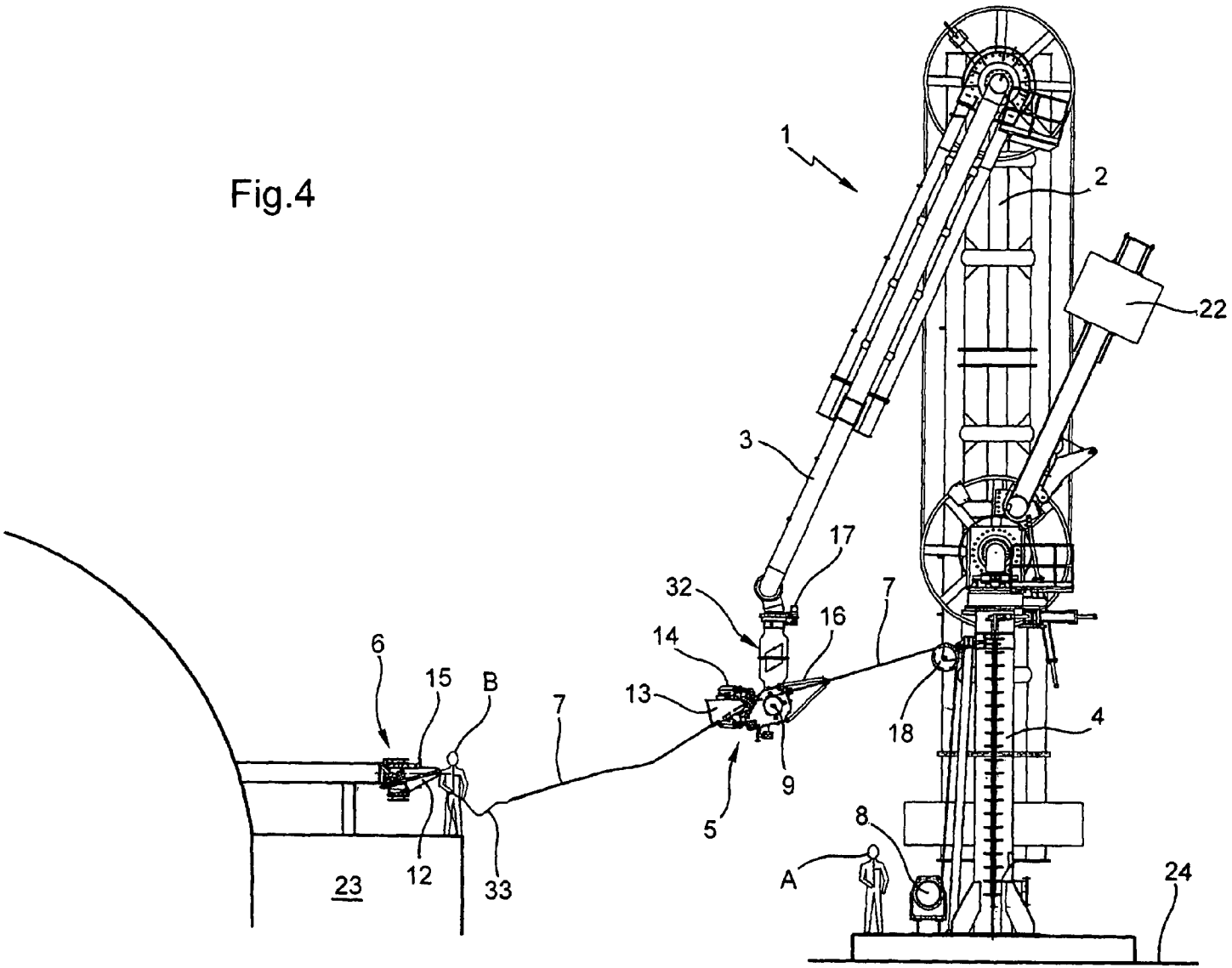
Figure 5:
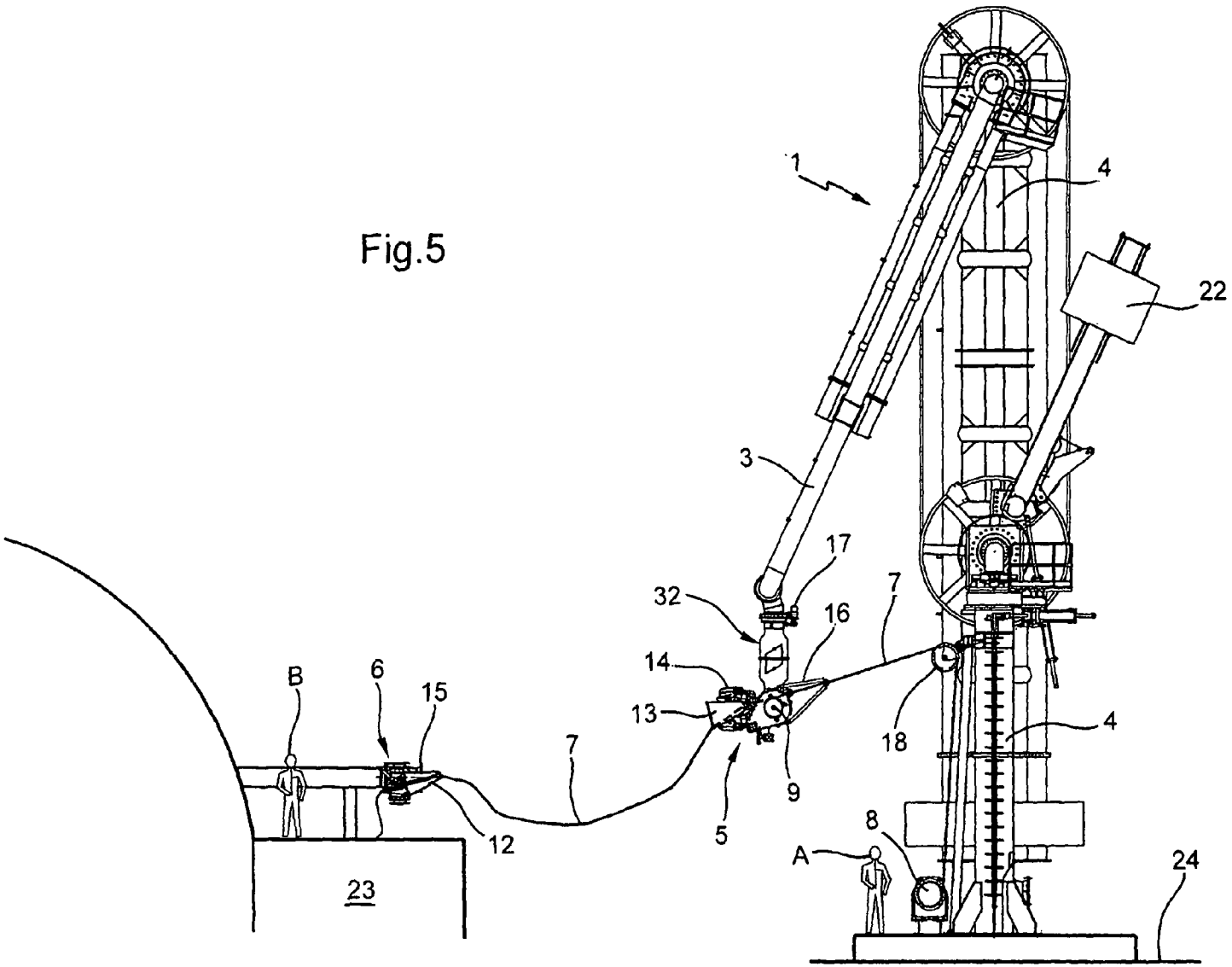
Figure 6:
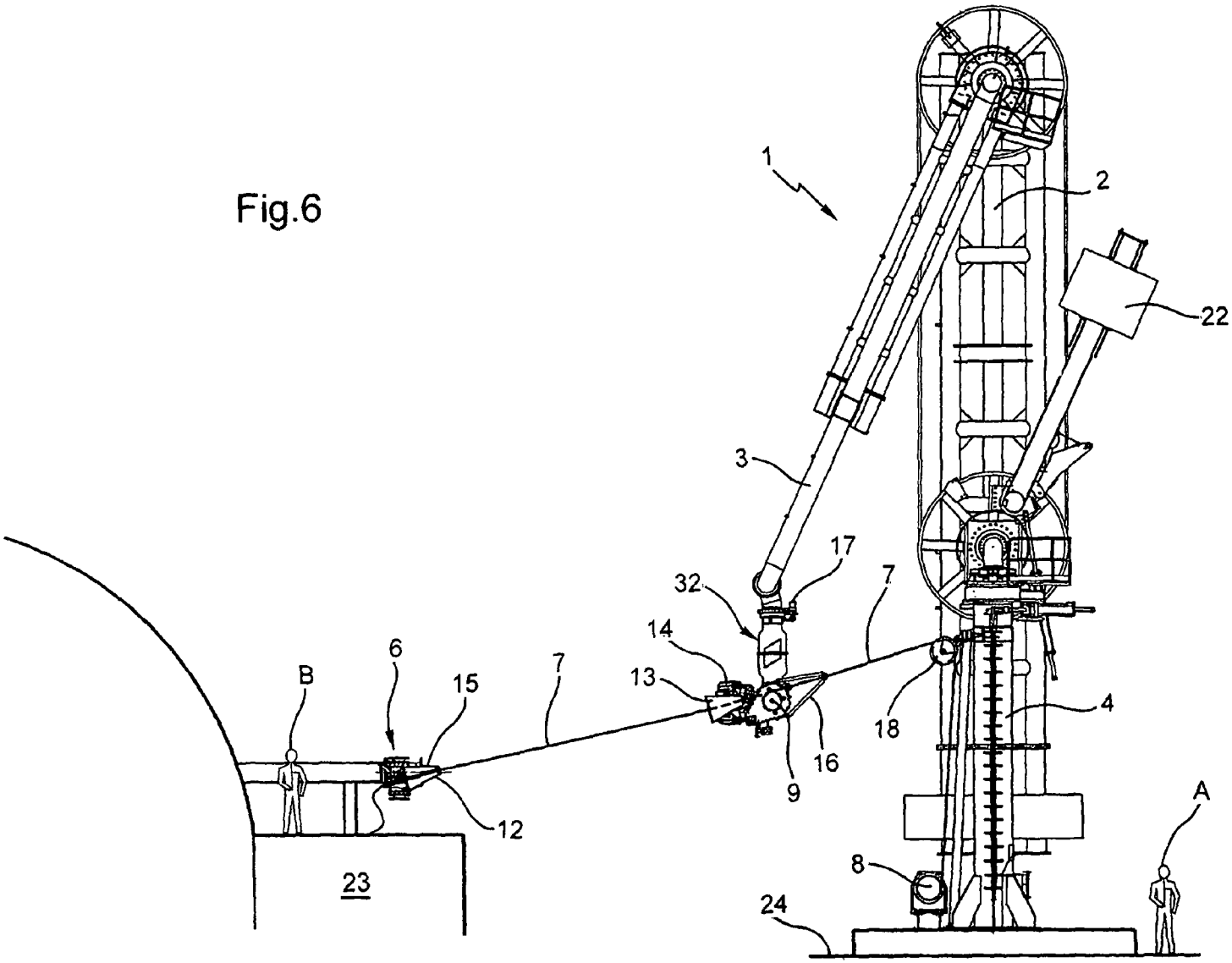
Figure 7:
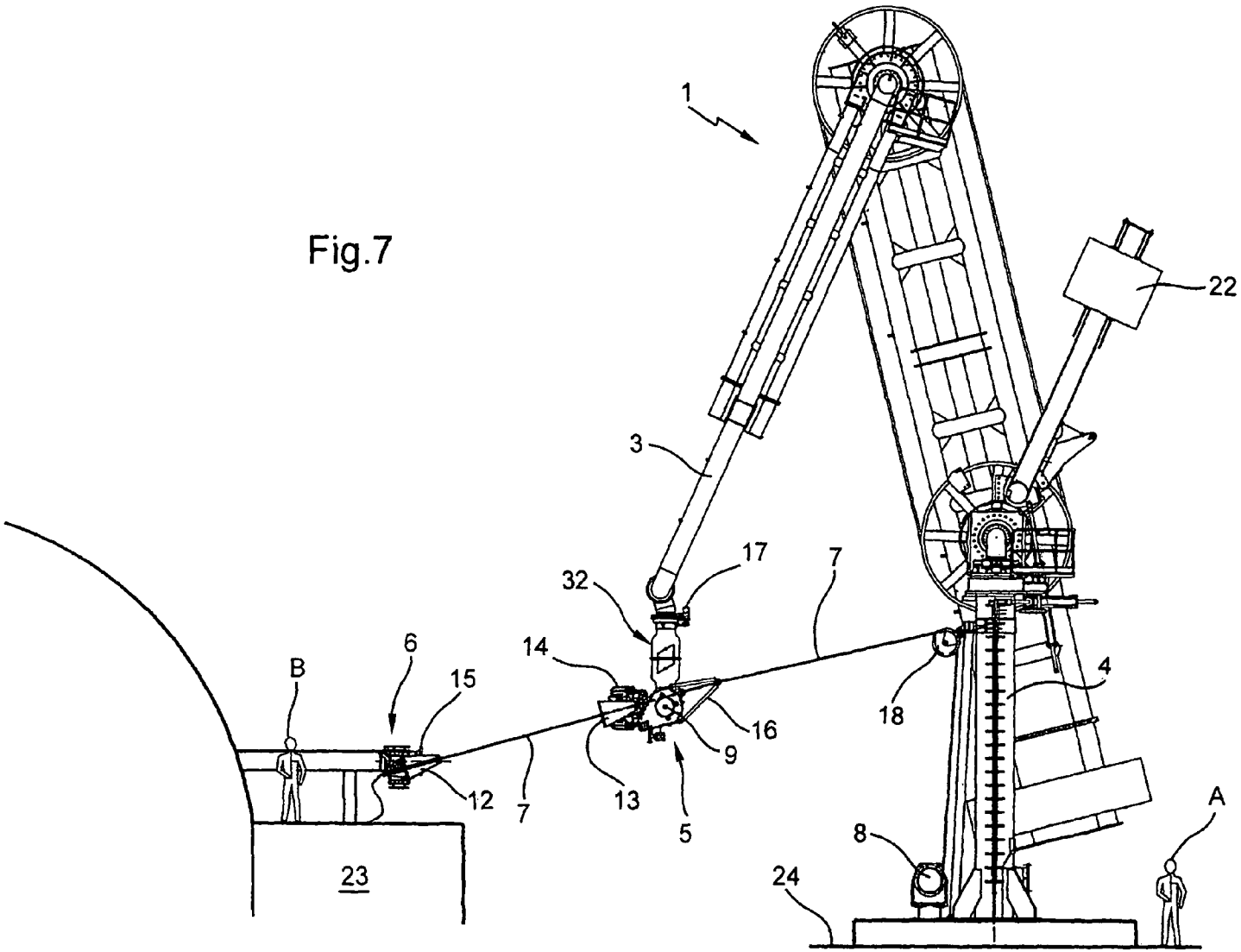
Figure 8:
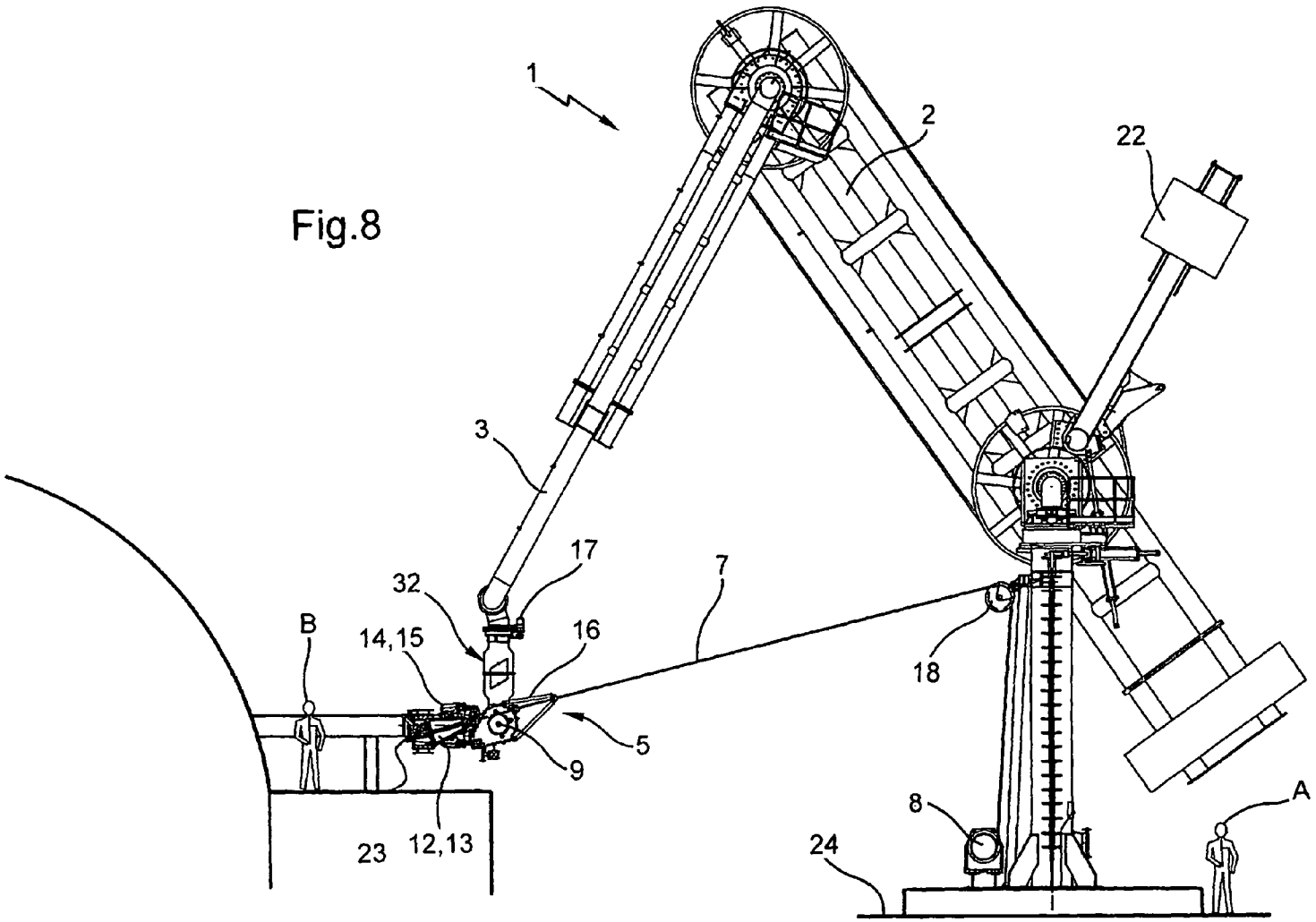
Figure 10:
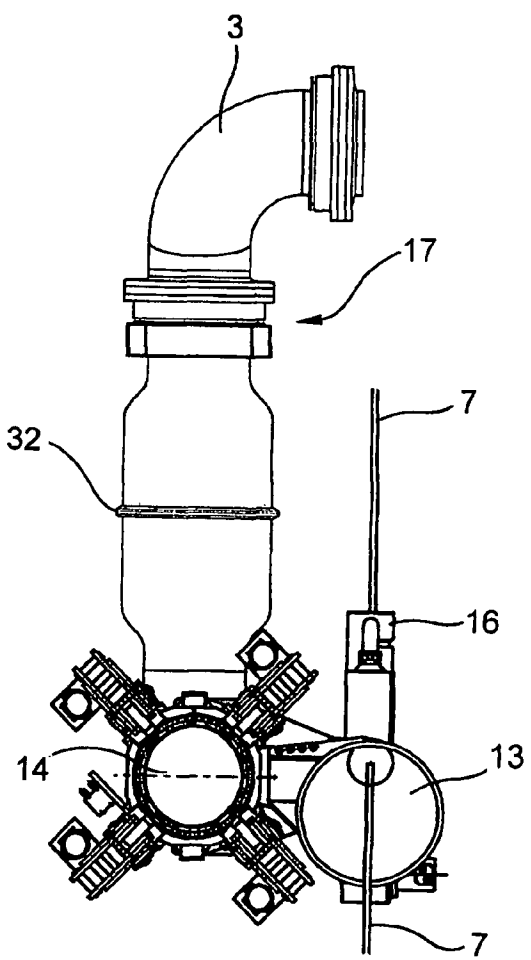
Figure 9:
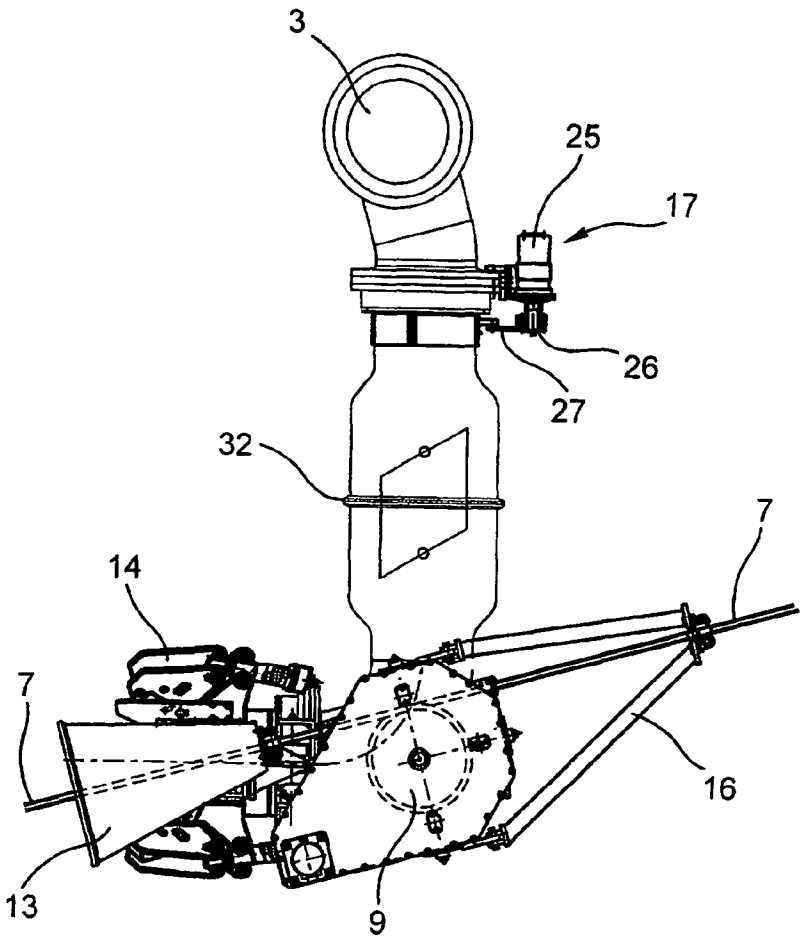
FIG. 9 represents the connection system for the set of FIGS. 1 to 8.
Figure 11:
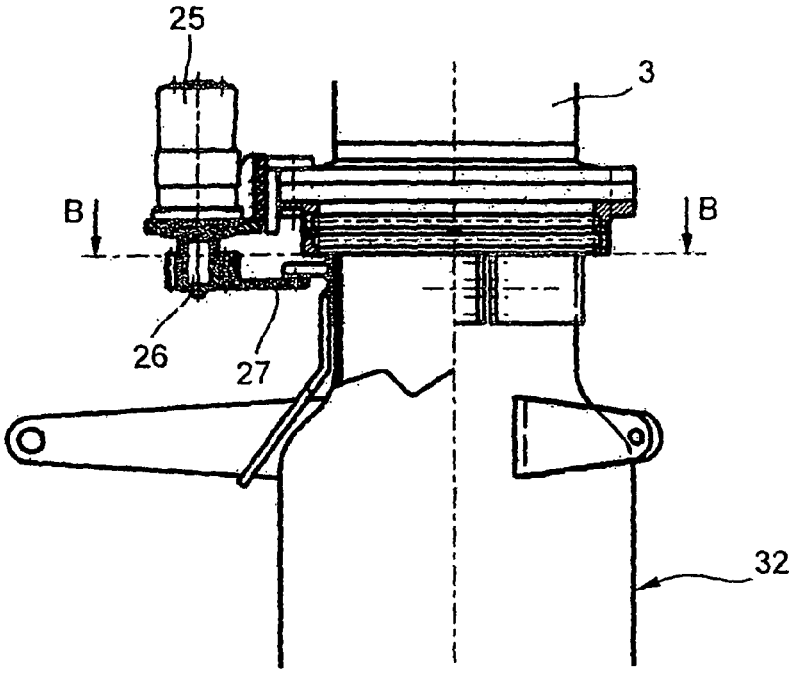
FIG. 11 is an elevation view of the upper part of the connection system of FIG. 9, showing along the section AA of FIG. 12 the rotation system of the connection system.
Figure 12:
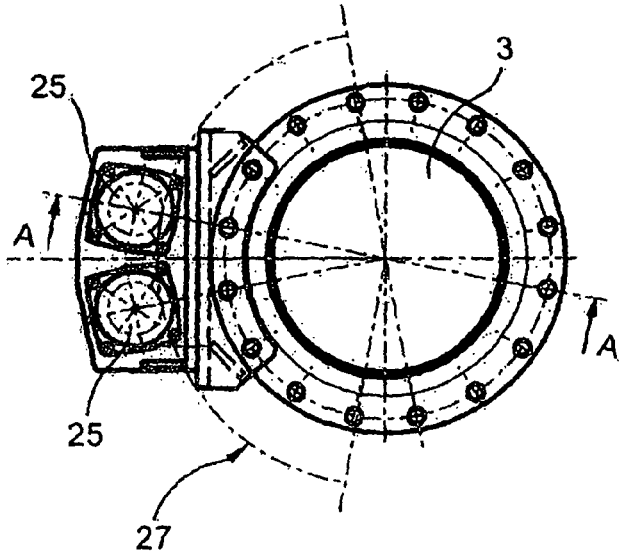
FIG. 12 is a view from above, along the section BB of FIG. 11.
Figure 13:
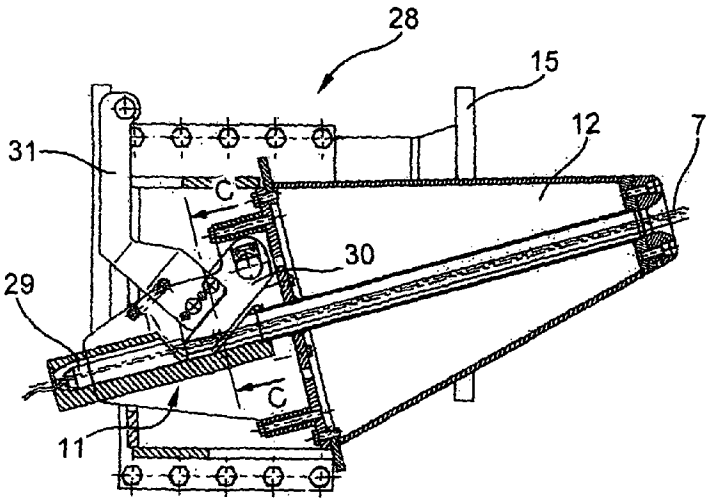
FIGS. 13 and 14 represent the reception cone situated on the vessel and also the locking system for the cable crossing it, the locking system being represented respectively in locked and unlocked positions.
Figure 14:
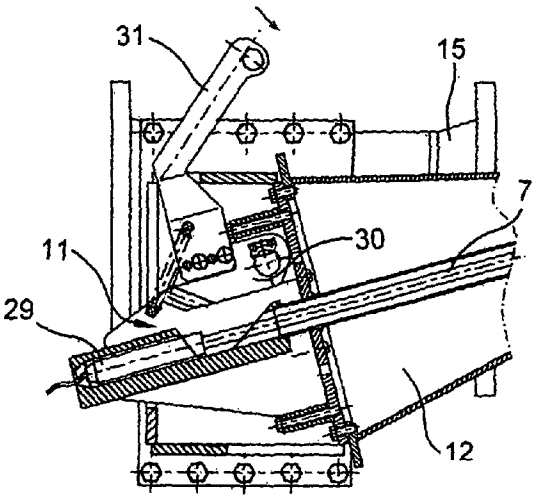
Figure 15:
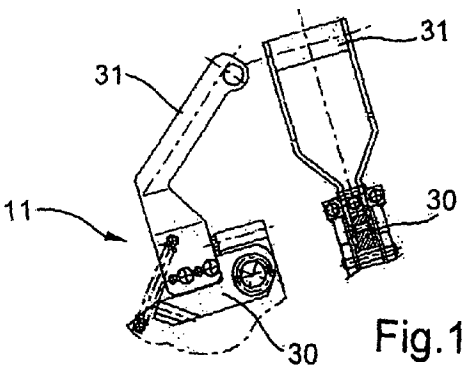
Figure 16:
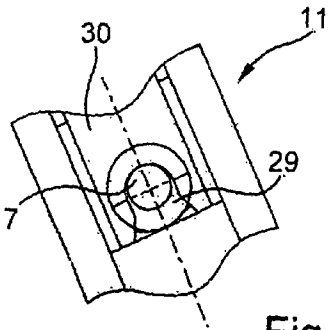
FIG. 16 is an enlarged view of the locking system along the section CC of FIG. 13.
Figure 17:
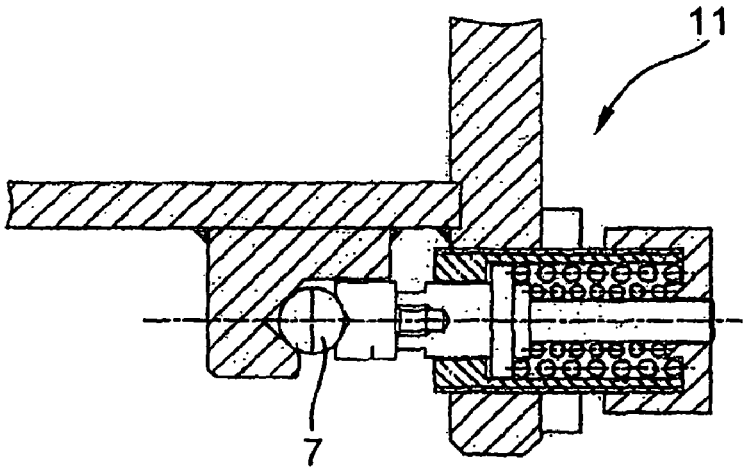
FIGS. 17 and 18 represent alternatives to the locking device for the cable, respectively mechanical and hydraulic.
Figure 18:
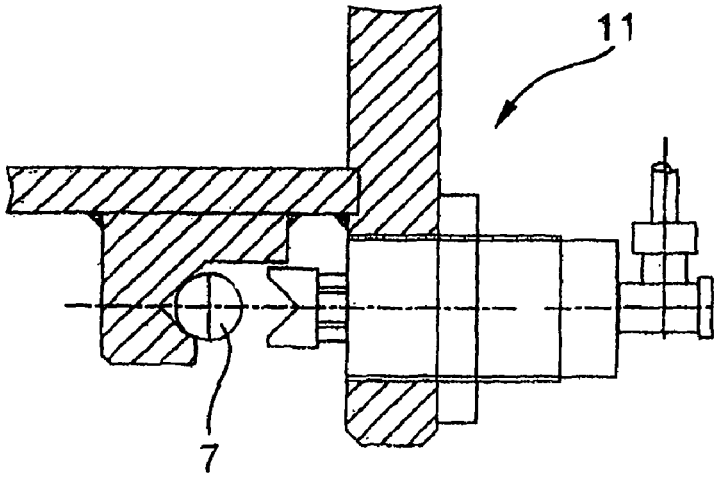
Figure 19:
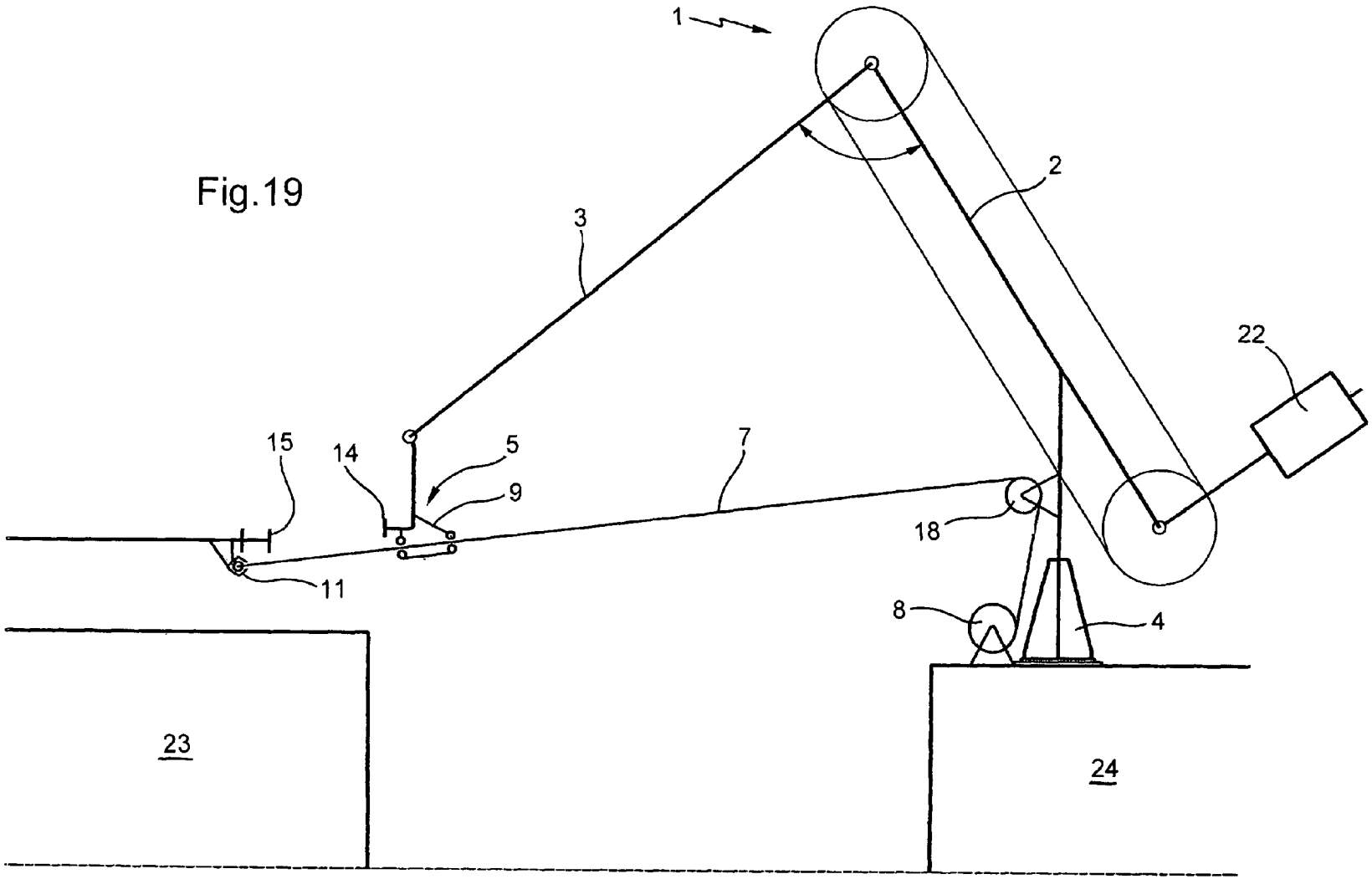
FIG. 19 is a kinematic diagram corresponding to the embodiment of FIGS. 1 to 8.

The so-called "constant-tension" winch will allow a cable to be kept stretched between the vessel, for example a liquid natural gas tanker, and the loading/unloading arm throughout the phase comprising approach, connection and disconnection at the manifold of the vessel. This cable will allow, via the drive winch, the connection system for the loading arm to brought close to the manifold of the vessel.

In order to guarantee a constant tension in the cable the winch winds on and unwinds according to the movements imposed between the vessel and the location on which the loading arm is installed. When the vessel approaches the arm, the winch winds on the cable, and when it moves away from it the winch allows the cable to unwind. A specific hydraulic control system applies a constant hydraulic pressure to the winch motor.

The constant-tension winch is installed at the foot of the base of the loading arm.

The guide pulley serves to orientate the cable between the constant-tension winch and the drive winch. It is orientatable along the three axes of rotation so as to best guide the cable, whatever the direction and the angle of engagement of the latter. The pulley is situated at the upper end of the base, just above the constant-tension winch.

The orientatable alignment guide is fixed onto the drive winch and is situated just behind the latter. It moves along an axis perpendicular to the cable and orientates itself at an angle, for example ranging from −30° to +30°. Its principal functions are to correctly guide the cable before entering the winch, and to orientate the connection system in the vertical plane. This guide accompanied by the cable allows the avoidance of too-sudden vertical movements, and also the front and rear balancings of the connection system.

The so-called "drive" winch is a mechanical assembly operated by a hydraulic motor. It is fixed at the connection system close to the alignment cone described below. It is located behind the coupling and moved off-centre relative to the axis of the latter. Its functions are to permit the connection system to progressively follow the movements of the liquid natural gas tanker, and to guide the loading arm as far as the manifold of the vessel. For this, the winch winds and unwinds on the cable at constant tension. It is actually the adhesion of the cable on the drum of the winch that allows the arm to be brought close to and moved away from the manifold. During this approach phase, the arm is in "free wheel" mode. To drive the arm, the winch must overcome the forces induced by the cable, the intrinsic mass of the arm and all other outside agents (wind, ice etc.). This hydraulic winch is controlled by the operator who works a control panel; it is he who decides whether or not to bring the arm close, by working the drive winch.

The hydraulic coupling is fitted with a female cone called "alignment cone" through which the cable passes at a constant tension. Upstream from the alignment cone, the cable passes into the drive winch and downstream from the cone is found the end of the cable which is locked by the system located on the vessel. The role of this centering cone is to precisely guide the connection system and in particular the coupling. At the end of the approach, the male cone, called "reception cone", which is located alongside the manifold of the vessel, fits inside the female cone. Thus fitting allows the coupling to be brought close to the manifold while avoiding the violent impacts which could damage the joints and the coupling itself. The cone also serves to align the coupling with the flange on board the vessel; it is situated alongside the coupling. In addition to the cone, it is possible to use an orientation device for the connection system, in order to best prepare the alignment between the two elements. This orientation device can comprise a device for rotating the connection system relative to the articulated arm.

The whole of the connection system is in fact here fitted with a rotation device independent of the rest of the equipment, and permits angular orientation in the desired direction of the coupling and the system for connecting the arm (cone, drive winch, orientatable guide). This system allows the operator to centre the coupling with the manifold of the vessel during the final approach phase. It is composed of two hydraulic motors fitted with drive pinion, as well as a crown gear. This orientation system is installed at the upper-rotation level of the connection system generally called "median rotation"

An equivalent system can for example be developed from a jack and connecting rods.

The horizontal orientation (the trim) is obtained with the help of the orientatable guide and the guide rollers situated behind the female cone.

A single cable stretched at a constant tension can thus serve as a link and guide between the manifold of the vessel and the system for connecting the loading arm.

On the vessel, a guiding assembly is installed right alongside the manifold. This assembly is composed in particular of a male reception cone through which the cable passes equipped with a sleeve at its end, as well as a mechanical locking system allowing this cable under constant tension to be kept in place. This system is essentially composed of an indexable bolt fixed to an operating handle. The bolt is actually a piece having at its lower end a longitudinal rounded shape through which the cable passes. As the sleeve (crimping) has a diameter greater than that of the cable, this is "trapped" after having entered the guiding tube and after the bolt has been lowered. When at rest, the bolt is in fact in a position of flanging the sleeve of the cable. As the bolt is fitted with a return system, when the operator pulls on the rope hitched to the end of the sleeve, the latter acts on the bolt so that the latter closes as soon as the sleeve has passed completely behind it.

The guiding/locking assembly is thus capable of withstanding very strong forces.

In the event of a problem during the loading/unloading of the vessel, the connection assembly is fitted with an emergency disconnection system. This system is composed in particular of an ERS (assembly of two valves which close and separate). As this equipment is well known, it will not be described in more detail here. The emergency disconnection system also comprises a means of releasing the cable in the case of an abnormal gap between the vessel and the arm. The cable release system is here installed at the constant-tension winch. The cable is wound onto the drum of the winch and its free end is kept engaged in a cubicle, by three mechanical spring thrusters (not represented). Three additional thrusters, these being hydraulic, can also be used in parallel to the mechanical thrusters.

In the event of a major unwinding of the cable, the three hydraulic thrusters are capable of unlocking themselves. At the end of unwinding, the cable is held only by the three mechanical thrusters, which can release the cable with the help of the tractive force engendered in the latter.

The connection-assistance system is thus composed of a constant-tension winch and a drive winch, permitting movement of the loading arm, by friction, on a single cable kept stretched at a nominal tension.

To connect the loading/unloading arm, the following stages can be envisaged, independently of one another:

- unlock the arm, then open the compass by a few degrees so as to position the arm in an intermediate position;
- unwind the cable;
- an operator A, who is located to the side of loading arm throws the rope, hitched to the sleeve of the constant-tension cable, to an operator B on the vessel;
- operator B pulls the rope so as to haul the cable up onto the deck of the vessel, simultaneously with operator A who unwinds the cable;
- operator B passes the rope through the male guide cone, then pulls the sleeve and the cable through the latter;
- lock the sleeve of the cable with the help of the mechanical system located in the extension of the cone;
- start the constant-tension winch, so as to pre-tension the cable;
- open the inner and outer tubes (the compass) so as to place the arm in an intermediate position between a stored state and a connection state;
- start a function permitting the cable to be stretched at its nominal tension. At the moment when this function is started, the loading arm passes into free wheel mode. With the cable hitched to the vessel and passing through the drive winch situated at the connection system, the arm then freely accompanies the vessel in its movements;
- at the final approach, just before the cones engage in each other, it is possible to use the system for rotating the connection system, in order to best align the coupling with the manifold of the vessel;
- start the drive winch so as to engage the two cones and permit the alignment of the coupling with the manifold;
- close the coupling on the manifold;
- apply a reduced constant tension in the cable, throughout the loading/unloading phase.

To disconnect the loading/unloading arm, the following steps can be envisaged, independently of one another:

- with the loading arm connected to the manifold of the vessel and a reduced tension being applied in the cable, stretch the cable to its nominal tension;
- open the coupling;
- start the drive winch so as to remove the arm from the manifold and position the arm in an intermediate position between the connected state and the resting state;
- pre-stress the cable to a reduced constant tension;
- move the arm into its storage position;
- remove any stress in the cable and unwind it slightly;
- manually release the sleeve from the cable using the handle provided for this purpose;
- unwind the cable using the constant-tension winch until the sleeve reaches the female cone;
- lock the loading arm.

Although the cones or guiding elements are used for orientation and permit the coupling to be brought close to the manifold of the vessel without impacts, in the case described above these are not aligned relative to the axes of the coupling and of the manifold. The coupling and the manifold are orientated in one direction, whereas the connection-assistance assembly is orientated in another. The orientatable guide, the drive winch and the male and female guide cones are all orientated in the same direction. Other cases can be developed, consideration being given for example to guiding tubes or frusta parallel to the axes of the coupling and of the manifold.

The invention can comprise, in particular in view of the following elements, independent of one another:

- the connection of the loading/unloading arm to the manifold of the vessel is possible through a drive winch advancing by adhesion on a stretched cable or indeed by a device including an approach winch integral with the base and a return pulley on the vessel;
- a single cable subjected to constant tension allows the loading arm to be guided as far as the manifold of the vessel;
- the cable can be fitted at its free end with a crimped sleeve permitting a locking system to keep the cable on the vessel;
- the system for locking the cable can be situated on the deck of the ship, right alongside the manifold;
- the cable passes through all the guiding and operating elements;
- the system according to the invention comprises a system for applying constant tension (winch, jack, counterweight);
- the system for applying constant tension, the winch in the case described previously, is fitted with an emergency disconnection system;
- the system for emergency disconnection of the cable can be mechanical, hydraulic or other;
- the vertical orientation (the trim) of the connection system is established in particular through the orientatable guide situated on the back of the drive winch;
- the axial orientation of the coupling and of the manifold is possible thanks to the guiding elements (cones or tubes etc.) and to the motorized system for orientation of the connection system.

Figure 20:
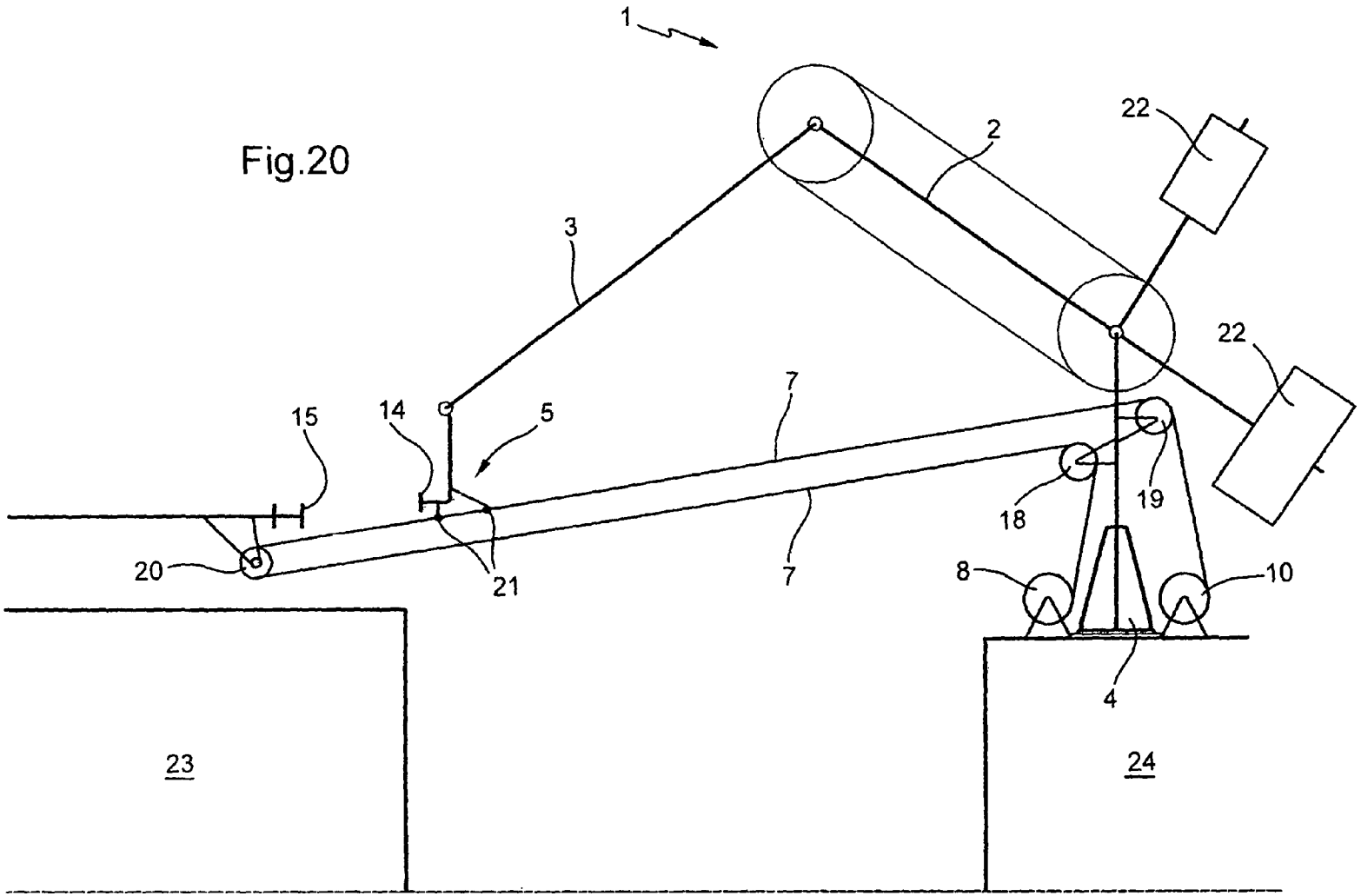
FIG. 20 is a kinematic diagram corresponding to another embodiment of the invention.

FIG. 20 represents another embodiment of the invention according to which the cable, instead of being locked on the vessel, passes through a return pulley attached to the vessel so that two parallel strands of the cable join the jetty and the vessel. The end of the cable that has come from the return pulley is wound up by an "approach" winch integral with the base, thanks to another guide pulley. In addition, the connection system is joined in a fixed manner to the cable, for example by a system of hydraulic clips, and the movement of the connection system along the cable is then controlled by the approach winch.

The reference signs used for the corresponding elements shown on the drawings are indicated below:

1. Articulated loading and unloading arm
2. Tube in which the product to be loaded or unloaded circulates, in compass form
3. Idem (2.)
4. Base
5. System for connecting the compass-style duct system to a coupling means
6. Coupling means of the vessel
7. Cable
8. Constant-tension winch
9. Drive winch
10. Approach winch
11. System for locking the cable on the vessel
12. Reception cone
13. Alignment cone
14. Hydraulic coupling
15. Manifold
16. Orientatable alignment guide
17. Device for rotating the connection system relative to the compass-style duct system
18. Guide pulley to the constant-tension winch
19. Guide pulley to the approach winch

20. Return pulley attached to the vessel
21. Points of attachment of the connection system on the cable
22. Balance weights
23. Vessel
24. Jetty
25. Hydraulic motors of the rotation device
26. Drive pinions integral with the motors 25
27. Crown gear with the connection system
28. Guiding assembly installed on the vessel
29. Sleeve fitted to the end of the cable
30. Indexable bolt for the locking of the sleeve 29
31. Handle for operating the bolt 30
32. Emergency disconnection system
33. Rope hitched to the sleeve of the cable

The invention claimed is:

1. An assembly for loading and unloading products which comprises:

a balanced loading and unloading arm which is installed at a first location and which includes a compass-style duct system having a first end mounted on a base and a second end provided with a connection system suitable for connecting the compass-style duct system to a coupling means installed at a second location;

a cable which prior to product loading and unloading operations is secured between the first and second locations;

means at the first location for subjecting the cable to a constant tension; and means co-operating with the cable for guiding the connection system along the cable until the connection system is brought into a position adjacent the coupling means;

wherein the guiding means comprises a drive winch which is connected to the connection system and which in operation frictionally engages the cable to drive the connection system along the cable between the first and second locations.

2. The loading and unloading assembly according to claim 1, wherein the cable comprises means for co-operating with a locking system at the second location to thereby keep the cable attached to the second location.

3. The loading and unloading assembly according to claim 2, wherein the means for co-operating with the locking system comprises a sleeve which is crimped onto the cable.

4. The loading and unloading assembly according to claim 1, wherein the cable crosses through the connection system from the first location to the second location.

5. The loading and unloading assembly according to claim 1, wherein the constant tension means comprises an emergency disconnection system for the cable.

6. The loading and unloading assembly according to claim 5, wherein the constant tension means comprises a winder and the emergency disconnection system functions to release the cable from the winder when the cable is unwound beyond a predetermined maximum number of turns.

7. The loading and unloading assembly according to claim 1, further comprising an alignment guide which is connected to the connection system and which comprises a portion through which the cable passes which is spaced apart from the connection system.

8. The loading and unloading assembly according to claim 1, further comprising a rotation device capable of ordering an angular movement of the connection system relative to the compass-style duct system.

9. The loading and unloading system according to claim 1, further comprising means for coupling the connection system to the second location.

10. The loading and unloading system according to claim 9, wherein the connection system comprises a female truncated conical element and the coupling means comprises a male truncated conical element which is adapted to fittingly engage the female truncated conical element.

11. An assembly for loading and unloading products between a first location and a second location which comprises:

a balanced loading and unloading arm which is installed at the first location and which includes a compass-style duct system having a first end mounted on a base and a second end provided with a connection system for connecting the compass-style duct system to the second location;

a cable which prior to product loading and unloading operations is stretched between the first and second locations; and a winch which engages the cable and which when activated moves the connection system from the first location to the second location;

wherein the winch is supported on the connection system and when activated frictionally engages the cable to move the connection system along the cable from the first location.

12. An assembly for loading and unloading products between a first location and a second location which comprises:

a balanced loading and unloading arm which is installed at the first location and which includes a compass-style duct system having a first end mounted on a base and a second end provided with a connection system for connecting the compass-style duct system to the second location;

a cable which is securely connected to the connection system; and a winch which engages the cable and which when activated moves the connection system along the cable from the first location to the second location;

wherein a first end of the cable is connected to the first location, a second end of the cable is connected to the winch and the cable is wound around a pulley which is positioned at the second location.

13. The assembly of claim 12, wherein the winch is positioned at the first location.

14. The assembly of claim 12, wherein the first end of the cable is connected to means positioned at the first location for subjecting the cable to a constant tension.

15. The assembly of claim 12, further comprising means for attaching the connection system to the cable.

16. The assembly of claim 15, wherein the attaching means comprises a number of hydraulic clips.

* * * * *

UNITED STATES PATENT AND TRADEMARK OFFICE

CERTIFICATE OF CORRECTION

PATENT NO. : 7,954,512 B2
APPLICATION NO. : 10/554040
DATED : June 7, 2011
INVENTOR(S) : Renaud Le Devehat It is certified that error appears in the above-identified patent and that said Letters Patent is hereby corrected as shown below:

Column 8, line 31, after "first location" add -- to the second location --.

Signed and Sealed this
Twentieth Day of September, 2011

David J. Kappos

David J. Kappos
*Director of the United States Patent and Trademark Office*